US010029286B2

(12) United States Patent
Shimada et al.

(10) Patent No.: US 10,029,286 B2
(45) Date of Patent: Jul. 24, 2018

(54) WIPER AND METHOD OF MANUFACTURING THE SAME

(71) Applicant: NITTA CORPORATION, Osaka-shi, Osaka (JP)

(72) Inventors: Tomohisa Shimada, Yamatokohriyama (JP); Yoshihiro Konishi, Yamatokohriyama (JP); Takeshi Kubota, Yamatokohriyama (JP); Yoshiyuki Yamamoto, Yamatokohriyama (JP); Yukio Teraguchi, Yamatokohriyama (JP)

(73) Assignee: NITTA CORPORATION, Osaka-Shi, Osaka (JP)

( * ) Notice: Subject to any disclaimer, the term of this patent is extended or adjusted under 35 U.S.C. 154(b) by 101 days.

(21) Appl. No.: 15/108,332

(22) PCT Filed: Dec. 25, 2014

(86) PCT No.: PCT/JP2014/084407

§ 371 (c)(1),
(2) Date: Jun. 27, 2016

(87) PCT Pub. No.: WO2015/099087

PCT Pub. Date: Jul. 2, 2015

(65) Prior Publication Data

US 2016/0325316 A1 Nov. 10, 2016

(30) Foreign Application Priority Data

Dec. 26, 2013 (JP) ..... 2013-268222

(51) Int. Cl.
*B08B 1/00* (2006.01)

(52) U.S. Cl.
CPC ..... *B08B 1/006* (2013.01)

(58) Field of Classification Search
CPC ..... B08B 1/006; B23Q 11/0875
See application file for complete search history.

(56) References Cited

U.S. PATENT DOCUMENTS 6,623,011 B1 9/2003 Ueda et al.

FOREIGN PATENT DOCUMENTS

| | | | |
|---|---|---|---|
| CN | 1349444 | A | 5/2002 |
| JP | 05-042443 | A | 2/1993 |
| JP | 2002-020558 | A | 1/2002 |
| JP | 2008-264776 | A | 11/2008 |

OTHER PUBLICATIONS

Chinese Office Action with English concise explanation, Chinese Patent Application No. 201480060672.X, dated Jun. 2, 2017, 9 pgs.
International Search Report, PCT/JP2014/084407, dated Mar. 24, 2015, 1 pg.

*Primary Examiner* — Shay Karls
(74) *Attorney, Agent, or Firm* — Volpe and Koenig, P.C.

(57) ABSTRACT

A wiper is made up of an attachment member to be attached to a machine tool, a wiper body formed integrally with the attachment member, a bent-shaped lip support part made of an elastic material and disposed at a lower end of the wiper body, and a lip part connected to the wiper body with the lip support part interposed therebetween. A lip front end portion of the lip part, a tip of which comes into contact with a sliding surface of the machine tool, is made of an elastic material containing an additive material for reinforcement.

7 Claims, 5 Drawing Sheets

Fig. 5

| Measuring items \ Kinds of wipers | | Example 1 | Example 2 | Example 3 | Example 4 | Example 5 | Comparative Example 1 | Comparative Example 2 |
|---|---|---|---|---|---|---|---|---|
| Pressing force per unit length (gf/cm) | | 145 | 158 | 183 | 181 | 125 | 437 | 330 |
| Sliding resistance per unit length (gf/cm) | | 104 | 97 | 97 | 104 | 56 | 183 | 260 |
| Wiper sliding test | Wiper sliding distance (km) | 2000 | | | | | 2000 | 300 |
| | Damage condition of wiper after sliding test | It is continuously usable without being damaged. | | | | | It is continuously usable without being damaged. | It is not usable because of breakage. |
| | Lip wear loss per unit length (mg/cm) | 1.9 | 2.1 | 3.5 | 4.0 | 3.4 | 8.4 | 17.2 |

WIPER AND METHOD OF MANUFACTURING THE SAME

TECHNICAL FIELD

Embodiments of the present invention respectively relate to a wiper for use in machine tools and industrial machinery and a method of manufacturing the wiper.

BACKGROUND ART

For the purpose of preventing clogging of foreign matters, such as chips, on a sliding surface of industrial machinery, such as a lathe and a milling machine, a wiper, whose lip part comes into contact with the sliding surface, has conventionally been attached to a short edge of a movable member. The foreign matters on the sliding surface of the industrial machinery are to be scraped by sliding the wiper. A rubber material having excellent followability and scraping performance in all directions is usually used for the sliding part of the wiper. In recent years, wipers for use in construction systems using no cutting oil (also called dry cutting) which regard environment as important, and in high speed machine tools have suffered from the problem that the rubber material of the sliding part of the wipers has a high coefficient of friction and hence causes severe wear, failing to maintain sealing properties over a long term.

To solve the above problems, for example, Patent document 1 has proposed a wiper whose entirety is molded from a short fiber reinforced rubber. The wiper contributes to short term wear prevention of a lip front end portion, however, has the problem that a lip support part in which a lip part is supported on a wiper body is also reinforced by short fiber, and therefore, flexibility of the lip part deteriorates due to high rigidity of the lip support part. Accordingly, when the wiper is used by being attached to a machine tool, a large pressing force of the wiper increases frictional force between the wiper and the sliding surface. Hence, wear occurs with long-term use, and there arises the problems that sealing properties deteriorates and the sliding surface of a thin sheet metal cover is damaged.

As described in Patent document 2, a wiper has been known which contributes to the short-term wear prevention by molding a sliding part of the wiper with a short fiber reinforced rubber, and polishing a contact part of the sliding part with respect to a surface to be cleaned. The wiper, whose sliding part is molded with the short fiber reinforced rubber, contributes to the short-term wear prevention of a lip front end. It is, however, known that a short fiber material to be added needs controls to ensure that the short fiber material is oriented in a certain direction in a rubber molding process, and that the contact part of the sliding part with respect to the surface to be cleaned needs polishing. Thus, the use of the short fiber material involves the troublesome molding process and expensive processing costs.

RELATED ART DOCUMENTS

Patent Documents

Patent Document 1: Japanese Unexamined Patent Publication No. H05-042443

Patent Document 2: Japanese Unexamined Patent Publication No. 2008-264776

SUMMARY OF THE INVENTION

Problems to be Solved by the Invention

In the wiper for use in the sliding surface of the industrial machinery, such as the lathe and the milling machine, the short-term wear prevention measures for the sliding part of the wiper has been known. However, the flexibility deterioration of the lip part and the expensive processing costs of the wiper remain unsolved.

The problem to be solved by the present invention is to provide a wiper which is capable of maintaining sealing properties of the wiper over a long term, and which is manufacturable by a simple manufacturing process, and also provide a method of manufacturing the wiper.

Means for Solving the Problems

An embodiment of the present invention provides a wiper including an attachment member to be attached to a machine tool, a wiper body having a wiper attachment part connected to the attachment member and a bent-shaped lip support part composed of an elastic material and disposed at one end of the wiper attachment part, and a lip part connected to the wiper attachment part with the lip support part interposed therebetween. A lip front end portion of the lip part, a tip of which comes into contact with a sliding surface of the machine tool, comprises an elastic material containing a particulate reinforcing material and a particulate solid lubricating resin material.

Another embodiment of the present invention provides a method of manufacturing a wiper having a lip front end portion, a tip of which comes into contact with a sliding surface of a machine tool, is to be formed by using an elastic material containing, as an additive material, a particulate reinforcing material and a particulate solid lubricating resin material. The method includes the step of preparing a rubber material after subjected to kneading to be loaded into a metal mold, and a mixed material obtainable by incorporating, as the additive material, the reinforcing material and the solid lubricating resin material into the rubber material, the step of disposing, in the metal mold, a wiper attachment member having adhesive applied thereto, and loading the mixed material into a portion of the metal mold which corresponds to the lip front end portion, followed by loading the rubber material into a remaining space in the metal mold, and the step of integrally molding, by press vulcanization, a wiper attachment part to be connected to the attachment member, a lip support part to be formed at one end of the wiper attachment part, and the lip part to be connected to the wiper attachment part with the lip support part interposed therebetween.

Effects of the Invention

With the wiper and the method of manufacturing the wiper respectively according to the present embodiments, the sealing properties of the wiper is maintainable over a long term, and a machine tool is operable without replacement of the wiper, thus achieving an efficient manufacturing of workpieces.

BRIEF DESCRIPTION OF THE DRAWINGS

FIG. 5 is a table that presents measurement results of pressing force, sliding resistance, and sliding distance.

MODE FOR CARRYING OUT THE INVENTION

An embodiment for carrying out the present invention is described below.

The wiper of the present embodiment is a member being long in a transverse width direction, which is to be attached to a moving body that reciprocatingly moves relative to a sliding surface, such as a surface of a machine stand and a surface of a cover, in a machine tool.

Figure 1:
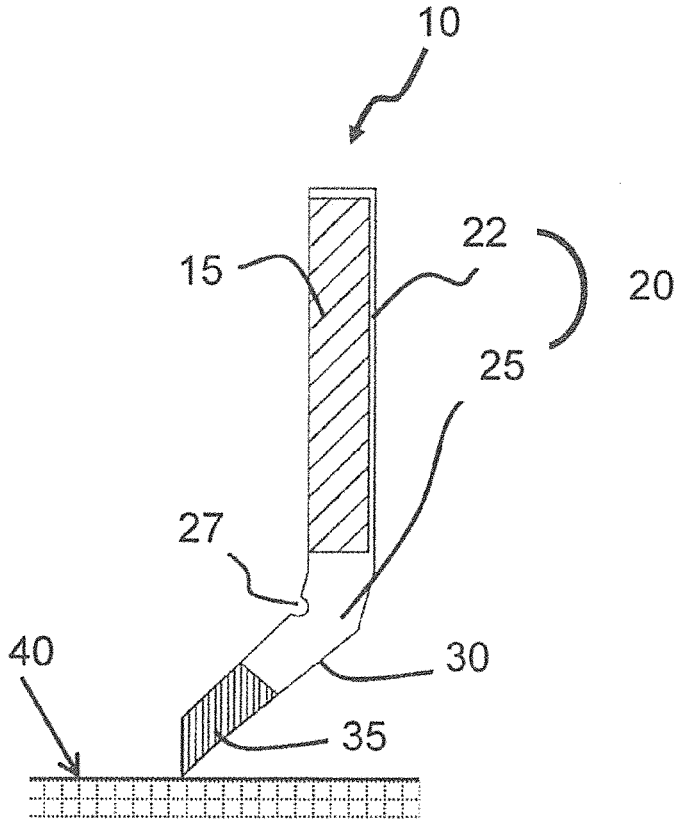
FIG. 1 is a sectional view of a wiper according to an embodiment.

FIG. 1 is a sectional view taken from a side surface of the wiper 10 of the present embodiment. As shown in FIG. 1, the wiper 10 is made up of an attachment member 15 to be attached to the moving body of the machine tool that moves relative to the sliding surface (scraping surface) 40, such as the surface of the machine stand and the surface of the cover, and a wiper body 20 formed integrally with the attachment member 15.

The wiper body 20 includes, for example, a wiper attachment part 22 and a lip support part 25. The attachment member 15 is usually made of a metal material or a synthetic resin material.

The wiper attachment part 22 has, at a lower end thereof, a lip support part 25 having a bent shape that is bent in an arrowed sliding direction, and a lip part 30 connected to the wiper attachment part 22 with the lip support part 25 interposed therebetween. The lip part 30 has, at a front end thereof, a lip front end portion 35 that slides while coming into contact with the sliding surface 40. A groove 27 having elastic action is disposed inside a bent part of the lip support part 25 (on the side toward the sliding direction).

The wiper attachment part 22 is made of an elastic material, such as NBR, urethane rubber, fluoro rubber, hydrogenated nitrile rubber (H-NBR), and carboxylated nitrile rubber (X-NBR). Alternatively, the wiper attachment part 22 may be formed by incorporating, as an additive material, 5 to 40 parts by mass of a particulate reinforcing material, such as a polyethylene resin particle material, a silica particle material, and a silica-alumina particle material, and 5 to 40 parts by mass of a particulate solid lubricating resin material, such as an acrylic-modified silicone resin particle material, polytetrafluoroethylene resin particle material, and a nylon resin particle material, relative to 100 parts by mass of the elastic material. When the incorporation of the particulate reinforcing material and the incorporation of the particulate solid lubricating resin material are respectively less than 5 parts by mass, a mixture distribution into the elastic material becomes non-uniform. This may deteriorate the effects of maintaining sealing properties of the wiper over a long term. When the incorporation of the particulate reinforcing material and the incorporation of the particulate solid lubricating resin material respectively exceed 40 parts by mass, an incorporation process of the additive materials becomes difficult.

The lip support part 25 and the lip part 30, excluding the lip front end portion 35, are made of a material similar to the elastic material. The lip front end portion 35 is formed by incorporating an additive material made up of the particulate reinforcing material and the particulate solid lubricating resin material into a material similar to the elastic material.

Figure 2:
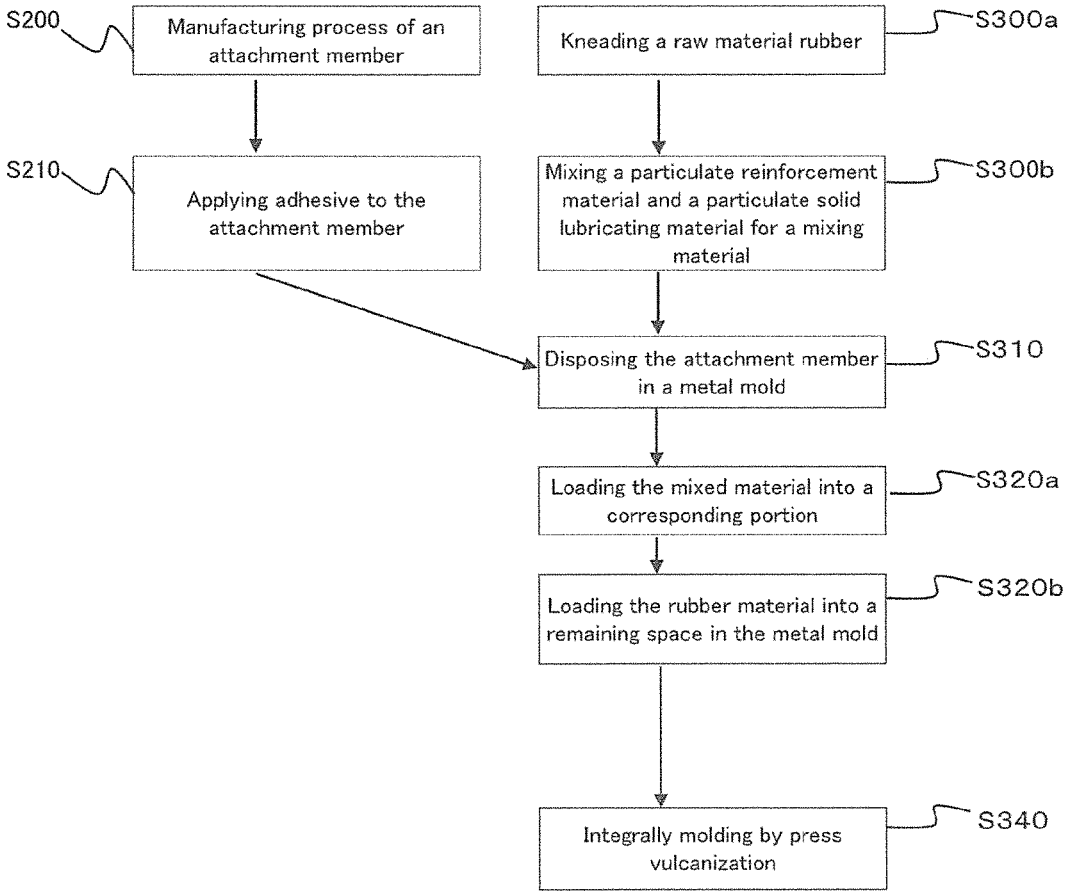
FIG. 2 is a flowchart of a manufacturing process of a wiper according to an embodiment.

The method of manufacturing the wiper 10 having the foregoing structure is described below. FIG. 2 is a flowchart that describes the manufacturing process of the wiper 10.

Firstly, in the manufacturing process of the attachment member 15, for example, a metal material or a synthetic resin material is processed into a predetermined shape (step S200).

Subsequently, adhesive is applied to the attachment member 15 processed into the predetermined shape (step S210).

In the manufacturing process of the wiper body 20 and the lip part 30, a rubber material and a mixed material to be loaded into a metal mold are prepared as follows. That is, the rubber material is prepared by kneading a raw material rubber (step S300*a*). The mixed material is prepared by mixing, as an additive material, a particulate reinforcing material and a particulate solid lubricating resin material into the rubber material (step S300*b*).

Subsequently, the attachment member 15 having the adhesive applied thereto in step S210 is disposed in the metal mold (step S310), and the mixed material is loaded into a corresponding portion in the metal mold (step S320*a*). The rubber material is also loaded into a remaining space in the metal mold (step S320*b*).

Thereafter, the attachment member 15, the wiper body 20, and the lip part 30 are integrally molded by press vulcanization (step S340).

The lip front end portion 35 is formed by incorporating, as an additive material, a particulate reinforcing material having no orientation, such as a short fiber material, and a particulate solid lubricating resin material into a rubber material. The wiper attachment part 22 is made of, for example, a rubber material. Alternatively, the wiper attachment part 22 may be formed by incorporating, as an additive material, a particulate reinforcing material having no orientation, such as a short fiber material, and a particulate solid lubricating resin material into a rubber material.

The lip part 30, excluding the lip front end portion 35, and the lip support part 25 are usually made of a rubber material into which neither a particulate reinforcing material nor a particulate solid lubricating resin material is incorporated.

A conventional manufacturing process of a wiper using the short fiber material as an additive material for reinforcement needs the process of controlling the orientation of the additive material for reinforcement in a certain direction, and the process of polishing the contact part of the sliding part with respect to the surface to be cleaned. On the other hand, with the manufacturing process of the present embodiment shown in FIG. 2, the particulate reinforcing material instead of the short fiber material and the particulate solid lubricating resin material are mixed together, thus requiring neither the process of controlling the orientation in the certain direction nor the process of polishing the contact part of the sliding part of the wiper 10 with respect to the surface to be cleaned. Hence, the present embodiment makes it possible to simplify an operation process.

EXAMPLES

Results of comparison between the manufacturing processes of Examples and those of Comparative Examples 1 and 2 are described below.

Example 1

As Example 1, a wiper was manufactured in the following manner. That is, X-NBR was used as an elastic material. The X-NBR had oil resistance after being molded, and had hardness set in a range of 70 degrees to 90 degrees (JISA). Only a region of the lip front end portion 35, whose length is half the length from the lip support part 25 to a lip front end, was formed by using an elastic material in which a particulate reinforcing material and a particulate solid lubricating resin material were incorporated as an additive material. Other parts were formed by using the X-NBR into which none of these additive materials was incorporated.

Two kinds of materials to be incorporated were 5 parts by mass of surface-treated ultrahigh molecular weight polyethylene particles (product name: INHANCE UH-1080 (manufactured by Fluoro-Seal, Ltd., USA), having a mean particle size of 125 W as a reinforcing material, and 5 parts by mass of silicone-acrylic copolymer resin particles (product name: CHALINE R (manufactured by Nissin Chemical Industry CO., Ltd.), having a mean particle size of 30 W as a solid lubricating resin material relative to 100 parts by mass of the elastic material.

The attachment member 15 was formed by using a resin material. More specifically, Example 1 was one in which the lip front end portion 35 was made of the rubber material that incorporates therein the particulate reinforcing material and the particulate solid lubricating resin material.

Example 2

A wiper was manufactured in the same manner as in Example 1, except that the two kinds of additive materials to be incorporated were 10 parts by mass of the surface-treated ultrahigh molecular weight polyethylene particles and 10 parts by mass of the silicone-acrylic copolymer resin particles relative to 100 parts by weight of the elastic material.

Example 3

A wiper was manufactured in the same manner as in Example 1, except that the two kinds of additive materials to be incorporated were 20 parts by mass of the surface-treated ultrahigh molecular weight polyethylene particles and 20 parts by mass of the silicone-acrylic copolymer resin particles relative to 100 parts by weight of the elastic material.

Example 4

A wiper was manufactured in the same manner as in Example 1, except that the two kinds of additive materials to be incorporated were 30 parts by mass of the surface-treated ultrahigh molecular weight polyethylene particles and 30 parts by mass of the silicone-acrylic copolymer resin particles relative to 100 parts by weight of the elastic material.

Example 5

A wiper was manufactured in the same manner as in Example 1, except that the two kinds of additive materials to be incorporated were 40 parts by mass of the surface-treated ultrahigh molecular weight polyethylene particles and 40 parts by mass of the silicone-acrylic copolymer resin particles relative to 100 parts by weight of the elastic material.

Comparative Example 1

A wiper 10 of Comparative Example 1 was manufactured in the same manner as in Example 1, except that the wiper body 20, the lip support part 25, the lip part 30, and the lip front end portion 35 were formed by using a rubber material (X-NBR) that incorporates therein an additive material for reinforcement similar to that of Example 1. The additive material for reinforcement was one that incorporates therein 10 parts by mass of nylon-based short fiber relative to 100 parts by mass of raw material rubber.

Comparative Example 2

A wiper 10 of Comparative Example 2 was manufactured in the same manner as in Example 1, except that the wiper body 20, the lip support part 25, the lip part 30, and the lip front end portion 35 were formed by using a rubber material (X-NBR) similar to that of Example 1, and neither the particulate reinforcing material nor the particulate solid lubricating resin material was incorporated into the rubber material.

FIG. 5 shows measurement results of performance evaluations of the wipers obtained in Examples 1 to 5 and Comparative Examples 1 and 2. The measurement results of the performance evaluations of the Examples 1 to 5 and Comparative Examples 1 and 2 are described below. Firstly, employed wiper evaluation methods are described below.

(1) Method of Measuring Pressing Force of Wiper

A. Test Method

Figure 3:
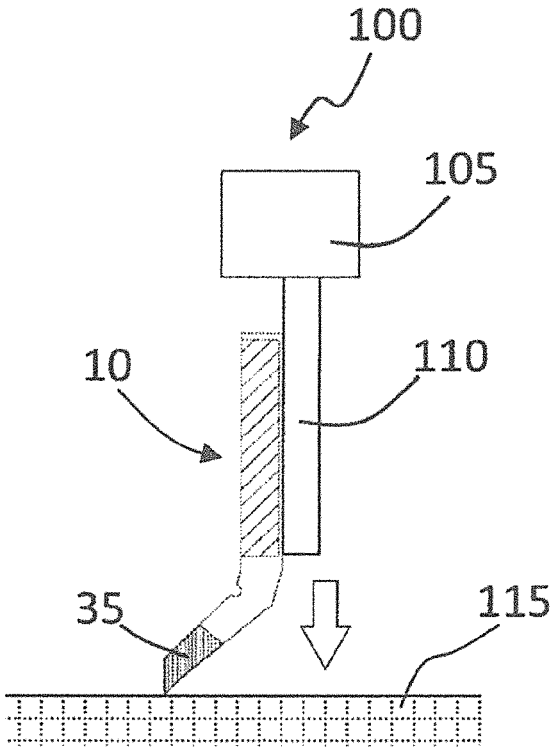
FIG. 3 is a diagram that describes a method of measuring pressing force of the wiper.

A wiper pressing force measurement testing machine 100 is made up of a load cell 105, a saddle 110, the wiper 10, and a sliding surface 115 as shown in FIG. 3. The wiper 10 is secured to the saddle 110, and the wiper 10 is lowered. The wiper 10 is then pressed against the sliding surface 115 by a default value of 3 mm from a point at which the lip front end 35 of the wiper 10 comes into contact with the surface of the sliding surface 115. The load cell 105 detects a force to be applied on that occasion, and a value thereof is defined as a pressing force. The pressing force is usually indicated by being converted into a value per unit centimeter. The pressing force is to be used as a vertical load (W) when measuring a wiper sliding resistance in the following paragraph.

Figure 4:
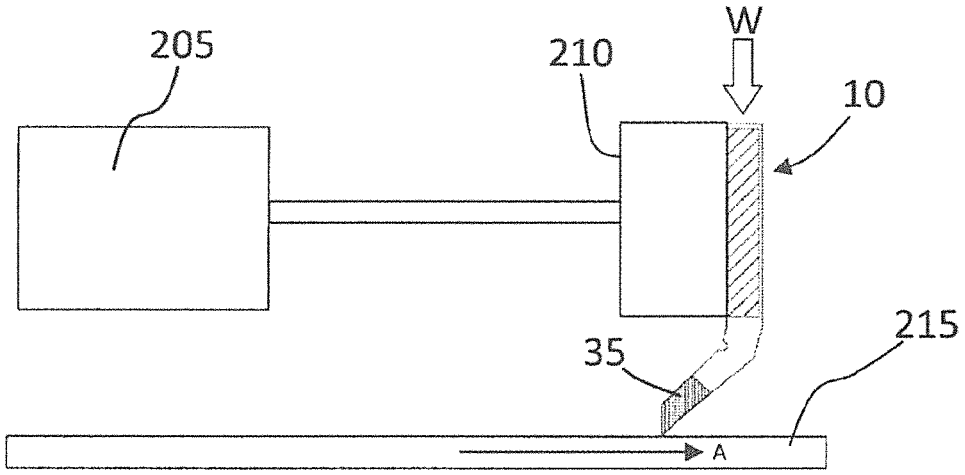
FIG. 4 is a diagram that describes a method of measuring a sliding resistance of the wiper.

B. Test Conditions: Using No Lubricant (2) Method of Measuring Wiper Sliding Resistance A. Test Method A wiper sliding resistance measurement testing machine 200 is made up of a load cell 205, a saddle 210, the wiper 10, and a sliding surface 215 as shown in FIG. 4. The sliding surface 215 is moved in an arrowed direction A with the wiper 10 secured to the saddle 210. The load cell 205 detects a horizontal force applied on that occasion. A sliding resistance F (kgf) is calculated from a value of the force F and a value of the inputted vertical load W (the force applied when the wiper is pressed by the default value of 3 mm in the measurement of the pressing force of the wiper) according to the equation $F=\mu W$, where $\mu$ is a coefficient of friction, and W is a pressing force (kgf). The sliding resistance F (kgf) when pressing by 3 mm is indicated by being converted into a value per unit centimeter.

B. Test Conditions

Using no lubricant; and

Sliding Speed: 6 m/min (3) Wiper Sliding Test Method

A. Test Method

A wiper sliding test was conducted using a testing machine similar to the wiper sliding resistance measurement testing machine 200 shown in FIG. 4. The wiper sliding test method is different from the wiper sliding resistance measurement method in that the saddle 210 is subjected to repetitive reciprocating movements. The wiper is subjected to the reciprocating movement with the wiper being pressed by 3 mm for a long period of time, and a sliding distance L of the wiper is calculated from a sliding distance and the number of the reciprocating movements. A lip wear loss is obtainable by measuring the weight of the wiper 10 before and after the test, and calculating a decrement between measured values. Subsequently, the wiper 10 is subjected to a test that a maximum sliding distance is 2000 km. The wipers are compared with one another in terms of sliding durability on the basis of a damage condition of the wiper and a lip wear loss after the test. The lip wear loss (mg/cm) per unit length shown in FIG. 5 is indicated by converting the lip wear loss after the 2000 km sliding into a value per unit centimeter.

B. Test Conditions

Using no lubricant;

Sliding speed: 70 m/min;

Sliding stroke: 1100 mm; and

Test environment: room temperature (4) Measurement Results

Measurements of pressing force, sliding resistance, and sliding distance were made on the wipers. FIG. 5 presents the measurement results. The results presented in FIG. 5 show the following.

Examples 1 to 5 have the pressing force that is approximately 55% or less than that of Comparative Example 2, the sliding resistance that is approximately 40% or less than that of Comparative Example 2, and the lip wear loss is 23% or less than that of Comparative Example 2. Examples 1 to 5 are capable of maintaining sealing properties over a long term, have a durable sliding distance that is approximately 6.7 times longer than 300 km of Comparative Example 2, and are not damaged after the 2000 km sliding, thus permitting continuous use. Hence, the wipers of Examples 1 to 5 are usable over a longer term than Comparative Example 2.

Examples 1 to 5 maintain a continuous usable state without any damage thereto even after the 2000 km sliding, and have the pressing force that is approximately 42% or less than that of Comparative Example 1 and the sliding resistance that is approximately 57% or less than that of Comparative Example 1. Although Comparative Example 1 maintains a continuous usable state without any damage thereto even after the 2000 km sliding, the lip wear loss of Example 1 is approximately 48% or less than that of Comparative Example 1. Hence, the wipers of Examples 1 to 5 are also usable over a longer term than Comparative Example 1.

As described above, the present embodiments use the wiper in which the predetermined region of the lip front end portion is made of the elastic material that incorporates therein the predetermined amount of the additive material for reinforcement. This ensures that the sealing properties of the wiper is maintainable over a longer term and the machine tool is usable without replacing the wiper over a long term. It is therefore possible to efficiently manufacture workpieces and also simplify a complicated manufacturing process, thereby reducing processing costs.

Although the several embodiments of the present invention have been described above, these embodiments are provided merely by way of example and are not intended to limit the scope of the invention. These embodiments are presented only by way of example, and not intended to limit the scope of the invention. These novel embodiments can be implemented in various other forms, and various omissions, replacements, and changes can be made without departing from the spirit of the invention. These embodiments and modifications thereof are included in the spirit and scope of the invention as well as in the invention set forth in the appended claims and the scope of equivalents thereof.

The invention claimed is:

1. A wiper comprising:

an attachment member to be attached to a machine tool;

a wiper body comprising a wiper attachment part connected to the attachment member and a bent-shaped lip support part composed of an elastic material and disposed at one end of the wiper attachment part; and a lip part connected to the wiper attachment part with the lip support part interposed therebetween, wherein a lip front end portion of the lip part, a tip of which comes into contact with a sliding surface of the machine tool, comprises an elastic material containing a particulate reinforcing material and a particulate solid lubricating resin material, and the lip front end portion comprises a smooth unpolished surface.

2. The wiper according to claim 1, wherein the wiper attachment part comprises an elastic material containing, as an additive material, the particulate reinforcing material and the particulate solid lubricating resin material.

3. The wiper according to claim 1, wherein the wiper attachment part and the lip front end portion comprise an elastic material containing a reinforcing material of polyethylene-based resin particles and a solid lubricating resin material of acrylic-modified silicone resin particles.

4. The wiper according to claim 1, wherein the elastic material comprises a rubber material, and the rubber material contains 5 to 40 parts by mass of the reinforcing material of polyethylene-based resin particles, and 5 to 40 parts by mass of the solid lubricating resin material of acrylic-modified silicone resin particles relative to 100 parts by mass of the rubber material.

5. A method of manufacturing a wiper having a lip front end portion, an unpolished tip of which comes into contact with a sliding surface of a machine tool, is to be formed by using an elastic material containing, as an additive material, a particulate reinforcing material and a particulate solid lubricating resin material, the method comprising:

preparing a rubber material subjected to kneading to be loaded into a metal mold, and a mixed material obtainable by incorporating, as an additive material, the reinforcing material and the solid lubricating resin material into the rubber material;

disposing, in the metal mold, a wiper attachment member having adhesive applied thereto, and loading the mixed material into a portion of the metal mold which corresponds to the lip front end portion, followed by loading the rubber material into a remaining space in the metal mold; and integrally molding, by press vulcanization, a wiper attachment part to be connected to the attachment member, a lip support part to be formed at one end of the wiper attachment part, and the lip part to be connected to the wiper attachment part with the lip support part interposed therebetween.

6. The method of manufacturing a wiper according to claim 5, comprising loading the mixed material into portions of the metal mold which respectively correspond to the wiper attachment part and the lip front end portion.

7. The method of manufacturing a wiper according to claim 5, wherein the mixed material comprises 5 to 40 parts by mass of a particulate reinforcing material, and 5 to 40 parts by mass of a particulate solid lubricating resin material relative to 100 parts by mass of the rubber material.

* * * * *